US007021085B2

(12) United States Patent
Ikeda et al.

(10) Patent No.: US 7,021,085 B2
(45) Date of Patent: Apr. 4, 2006

(54) CONCAVE AND CONVEX-PATTERNED MULTI-COLORED FIBER PILE FABRIC

(75) Inventors: Yuichiro Ikeda, Osaka (JP); Takuya Tamura, Komatsu (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 10/496,640

(22) PCT Filed: Sep. 19, 2003

(86) PCT No.: PCT/JP03/12018

§ 371 (c)(1),
(2), (4) Date: May 25, 2004

(87) PCT Pub. No.: WO2004/029348

PCT Pub. Date: Apr. 8, 2004

(65) Prior Publication Data

US 2005/0160770 A1 Jul. 28, 2005

(30) Foreign Application Priority Data

Sep. 26, 2002 (JP) ..... 2002-280704

(51) Int. Cl.
*D04B 21/02* (2006.01)

(52) U.S. Cl. ..... 66/191; 66/194; 139/391

(58) Field of Classification Search ..... 66/190–194, 66/202; 442/301, 312, 313; 139/384 R, 139/391, 396, 399, 406
See application file for complete search history.

(56) References Cited

U.S. PATENT DOCUMENTS 4,415,611 A * 11/1983 Yamagata et al. ..... 428/15
4,546,520 A * 10/1985 Wenzel et al. ..... 452/116
4,798,748 A * 1/1989 Kitamura et al. ..... 428/15

FOREIGN PATENT DOCUMENTS

| | | | |
|---|---|---|---|
| JP | 49-85361 | A | 12/1972 |
| JP | 49-85361 | A | 8/1974 |
| JP | 55-1307 | A | 6/1978 |
| JP | 55-1307 | A | 1/1980 |
| JP | 4-100949 | A | 4/1992 |
| JP | 5-222670 | A | 8/1993 |
| JP | 6-49731 | A | 2/1994 |
| JP | 10-110365 | A | 4/1998 |
| JP | 10/110365 | A | 4/1998 |
| JP | 63-145457 | A | 6/1998 |
| JP | 2000-226755 | A | 8/2000 |
| JP | 2000-282351 | A | 10/2000 |
| JP | 2001-271255 | A | 10/2001 |

* cited by examiner

*Primary Examiner*—Danny Worrell
(74) *Attorney, Agent, or Firm*—Sughrue Mion, PLLC

(57) ABSTRACT

The multi-colored fiber pile fabric of the present invention has at least one cut pile layer comprising a plurality of cut piles extending from at least one surface side of a knit or weave structure formed from organic fiber yarns, the cut pile layer comprises non-crimped pile fibers 5 formed from non-crimped organic fibers, crimped pile fibers 6 formed from crimped organic fibers and having a pile height lower than that of the non-crimped pile fibers 5 and crimped or non-crimped pile fibers 7 formed from crimped or non-crimped organic fibers and having a pile height lower than that of the crimped pile fibers 6, at least one type of pile fibers of the piles fibers 5, 6 and 7 having a color different in lightness or hue or lightness and hue from the other(s),

9 Claims, 4 Drawing Sheets

CONCAVE AND CONVEX-PATTERNED MULTI-COLORED FIBER PILE FABRIC

TECHNICAL FIELD

The present invention relates to a multi-colored pile fabric and a concave-and convex-patterned multicolored pile fabric. More particularly, the present invention relates to a multi-colored pile fabric having a cut pile layer formed from three, types of pile fibers different in pile height from each other, of which three types of pile fibers at least one type of pile fibers have a color different in lightness and-or hue from the others, and a concave-and convex-patterned multi-colored pile fabric in which a concave-and convex-pattern is formed in the above-mentioned cut pile layer of the multi-colored pile fabric.

BACKGROUND ART

Currently, a large amount of pile fabric is employed for car seats, etc. Particularly, recently, car seats are required to have improved properties and performances, and sometimes to be provided with multi-colored patterns and concave-and convex-patterns, in addition to the conventionally demanded properties and performances.

Japanese Unexamined Patent Publication No. 63-145457 discloses a multi-color patterned pile fabric in which the piles are formed from three different types of man-made fibers (filaments) consisting of high shrinkage fibers, moderate shrinkage fibers and low shrinkage fibers. In this type of pile fabric, though a natural fiber-like hand and color can be realized, concave-and convex-patterns cannot be sufficiently realized.

Japanese Unexamined Patent Publication No. 6-49731 discloses a pile fabric containing, as pile yarns, mixed filament yarns comprising two or more types of filaments different in dyeing property or color from each other. In this type of pile fabric, a grandrelle pattern can be formed. However, even in this type of pile fabric, a concave-and convex-pattern has not yet been realized. Further, Japanese Unexamined Patent Publication No. 2001-271255 discloses a pile fabric in which pile yarns produced from crimped filaments comprising a cationic dye-dyeable polyester and non-crimped polyester filaments are used. In this type of pile fabric, a formation of a concave-and convex-pattern has not yet been realized.

As mentioned above, in the conventional multi-colored pile fabrics, various devices for realizing multi-colored patterns have been made. However, the addition of the concave-and convex-patterns to the multi-colored patterns has not yet satisfactorily realized. Also, further development is desired to the multi-colored patterns on pile fabrics.

DISCLOSURE OF THE INVENTION

An object of the present invention is to provide a pile fabric having ample multi-colored patterns and capable of forming concave-and convex-patterns thereon, and a pile fabric having both the multi-colored patterns and the concave-and convex-patterns.

The multi-colored fiber pile fabric of the present invention comprises a ground structure portion having a knit or weave structure formed from organic fiber yarns and at least one cut pile layer comprising a plurality of cut piles, combined with the ground structure portion by a knitting or weaving procedure of the organic fiber yarns, and extending outward from at least one surface side of the ground structure portion, wherein the cut pile layer comprises (1) non-crimped pile fibers comprising non-crimped organic fibers, (2) crimped pile fibers comprising crimped organic fibers and having a pile height lower than that of the non-crimped pile fibers (1), and (3) crimped or non-crimped pile fibers comprising crimped or non-crimped organic fibers and having a pile height lower than that of the crimped pile fibers (2), and at least one type of pile fibers of the pile fibers (1), (2) and (3) having a color different in lightness or hue or in lightness and hue from the other or others.

In an embodiment of the multi-colored pile fabric of the present invention, the cut pile layer comprises mixed fiber cut piles, in each of which piles, three types of the pile fibers of the non-crimped pile fibers (1), the crimped pile fibers (2) and crimped or non-crimped pile fibers (3) are mixed altogether.

In another embodiment of the multi-colored pile fabric of the present invention, the cut pile layer comprises mixed fiber cut piles, in each of which piles, at least two types of pile fibers of the non-crimped pile fibers (1), the crimped pile fibers (2) and the crimped or non-crimped pile fibers (3) are mixed with each other.

In still another embodiment of the multi-colored pile fabric of the present invention, the cut pile layer comprises a plurality of non-crimped cut piles consisting of only the non-crimped pile fibers (1), a plurality of crimped cut piles consisting of only the crimped pile fibers (2) and a plurality of crimped or non-crimped cut piles consisting of only the crimped or non-crimped pile fibers (3).

In the multi-colored pile fabric of the present invention, the non-crimped pile fibers (1) are preferably selected from the group consisting of non-crimped polyethylene terephthalate fibers, non-crimped polybutylene terephthalate fibers, non-crimped polytetramethylene terephthalate fibers, and non-crimped polytrimethylene terephthalate fibers.

In the multi-colored-pile fabric of the present invention, the crimped pile fibers (2) are preferably selected from cationic dye-dyeable crimped polyester fibers.

In the multi-colored pile fabric of the present invention, the crimped or non-crimped pile fibers (3) preferably comprise a polyester copolymer, the principal monomers for the copolymer preferably being ethylene glycol and terephthalic acid, the comonomer copolymerized with the principal monomers preferably being at least one member selected from isophthalic acid, naphthalene dicarboxylic acid, adipic acid, and sebacic acid, diethyleneglycol, polyethyleneglycols, bis-phenol and bis-phenol sulfon.

In the multi-colored pile fabric of the present invention, one type of pile fiber of the non-crimped pile fibers (1) and the crimped or non-crimped pile fibers (3) are preferably colored with a pigment mixed into a polymer component from which the pile fibers are formed.

The concave-and convex-patterned multi-colored fiber pile fabric (1) of the present invention is produced from the multi-colored fiber pile fabric of the present invention as mentioned above, wherein in at least one partial region of the cut pile layers top portions of the non-crimped pile fibers (1) are removed by a chemical etching procedure to such an extent that the remaining non-crimped pile fibers (1-*a*) have a pile height controlled within the range of lower than that of the original non-crimped pile fibers (1) but not lower than that of the crimped pile fibers (2), to thereby increase the degree of exposure of the top portions of the crimped pile fibers (2) located in the partial region.

The concave-and convex-patterned multi-colored fiber pile fabric (2) is produced from the multi-colored fiber pile fabric of the present invention as mentioned above, wherein in at least one partial region of the cut pile layer, top portions of the non-crimped pile fibers (1) and the crimped pile fibers (2) are removed by a chemical etching procedure to such an extent that the remaining non-crimped pile fibers (1-*a*) and the remaining crimped pile fibers (2-*a*) have pile heights controlled within the range of lower than that of the original crimped pile fibers (2) but not lower than that of the crimped or non-crimped pile fibers (3), to thereby increase the degree of exposure of the top portions of the remaining crimped pile fibers (2-*a*) or the crimped and non-crimped pile fibers (3) located in the partial region.

BEST MODE OF CARRYING OUT THE INVENTION

The multi-colored fiber pile fabric comprises (A) a ground structure portion having a knit or weave structure formed from organic fiber yarns and (B) at least one cut pile layer. The cut pile layer is composed of a plurality of cut piles and combined with the ground structure portion by a knitting or weaving procedure of the organic fiber yarns. The cut piles extend outward from at least one surface side of the ground structure portion.

The cut pile layer of the multi-colored fiber pile fabric of the present invention comprises (1) non-crimped pile fibers comprising non-crimped organic fibers, (2) crimped pile fibers comprising crimped organic fibers and having a pile height lower than that of the non-crimped pile fibers (1); and (3) crimped or non-crimped pile fibers comprising crimped or non-crimped organic fibers and having a pile height lower than that of the crimped pile fibers (2), and at least one type of pile fibers (1), (2) and (3) having a color different in lightness or hue or in lightness and hue from the remaining type or types of the pile fibers.

In an embodiment of the multi-colored fiber pile fabric of the present invention, the cut pile layer comprises a plurality of cut piles each formed from mixed pile fibers comprising the above-mentioned non-crimped pile fibers (1), crimped pile fibers (2) and crimped or non-crimped pile fibers (3), namely three types of fiber-mixed cut piles.

Figure 1:
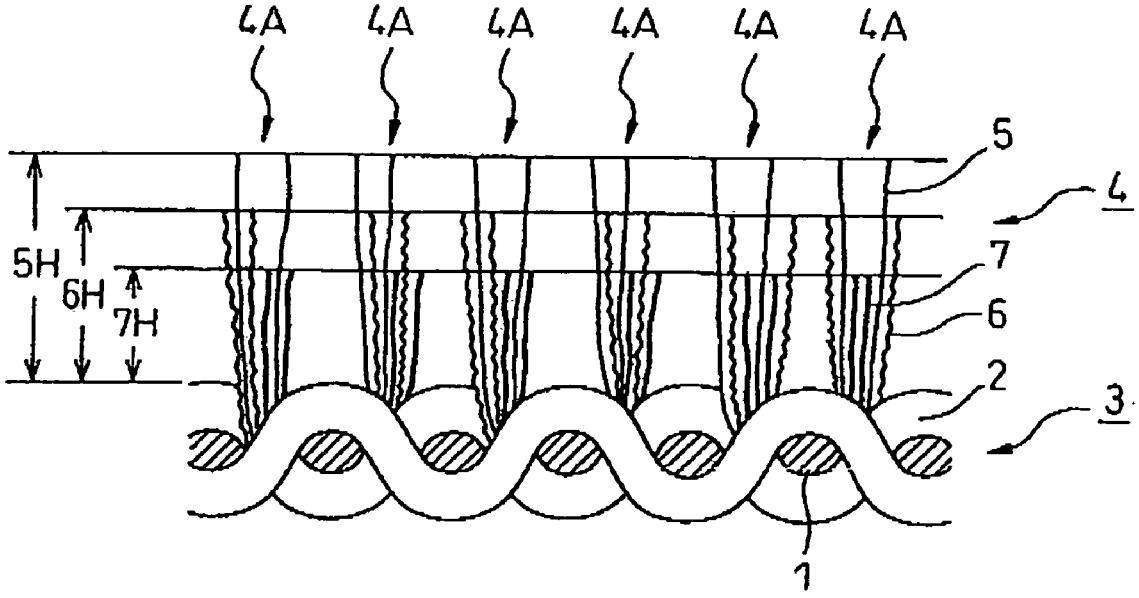
FIG. 1 shows an explanatory cross-sectional view of an embodiment of the multi-colored fiber pile fabric of the present invention.

In the multi-colored fiber pile fabric having a cross-sectional structure as shown in FIG. 1, a plurality of cut piles 4A formed from a plurality of pile-forming yarns. (not shown in FIG. 1) are incorporated, by a weaving procedure, into a ground structure portion 3 constituted from a plurality of warps 1 and a plurality of wefts 2 and having a weave structure, to thereby provide a cut pile layer 4 from the cut piles 4A. Each of the cut piles 4A is constituted from a plurality of non-crimped pile fibers 5, a plurality of crimped pile fibers 6 and a plurality of crimped or non-crimped pile fibers 7. The non-crimped pile fibers 5 have a highest pile height 5H (a distance between a mean surface of the ground structure portion and a top end of the pile fiber), the crimped pile fibers 6 have a pile height 6H lower than the pile height 5H, and the crimped or non-crimped pile fibers 7 has a pile height 7H lower than the pile height 6H.

In the pile fabric having the cross-sectional structure shown in FIG. 1, the crimped pile fibers 6 having a middle pile height cause the resultant cut fiber piles to exhibit an increased bulkiness and an enhanced resistance to flatting (being laid flat).

When the cut pile layer is observed from above, though the top portions of the non-crimped pile fibers 5 having a highest pile height 5H are well observed, the crimped pile fibers 6 having a middle pile height 6H are partially shielded by the top portions of the non-crimped pile fibers 5 and thus only the non-shield portions of the crimped pile fibers can be observed. Also, the crimped or non-crimped pile fibers 7 having a lowest pile height 7H are mostly covered by the non-crimped pile fibers 5 and the crimped pile fibers 6 and only some portions of the pile fibers 7 can be observed. Namely, in the case where, the pile fibers (1), (2) and (3) are different in lightness and/or hue from each other, in the appearance of the cut pile layer of FIG. 1 from above, the crimped pile fibers (2) are observed in a sprinkly colored pattern through the non-crimped pile fibers (1), and the crimped or non-crimped pile fibers (3) are also observed in a sprinkly colored pattern to an increased degree compared to that of the crimped pile fibers (2) through the pile fibers (1) and (2), and as a whole, a multi-colored pattern is provided. The amount of each of the pile fibers (1), (2) and (3) observable from above is variable in response to the pile heights, and presence or absence of crimps of the fibers, and thus various multi-colored patterns can be formed.

The mixed fiber mass ratios or mixed fiber number ratios of the pile fibers (1), (2) and (3) contained in each of the piles 4A can be appropriately established in dependence on the pattern, color and hand of the target pile fabric.

In another embodiment of the multi-colored fiber pile fabric of the present invention, the cut pile layer comprises two or more types of mixed fiber piles comprising at least two different types of mixed pile fibers of the above-mentioned non-crimped pile fibers (1), crimped pile fibers (2) and crimped or non-crimped pile fibers (3).

Figure 2:
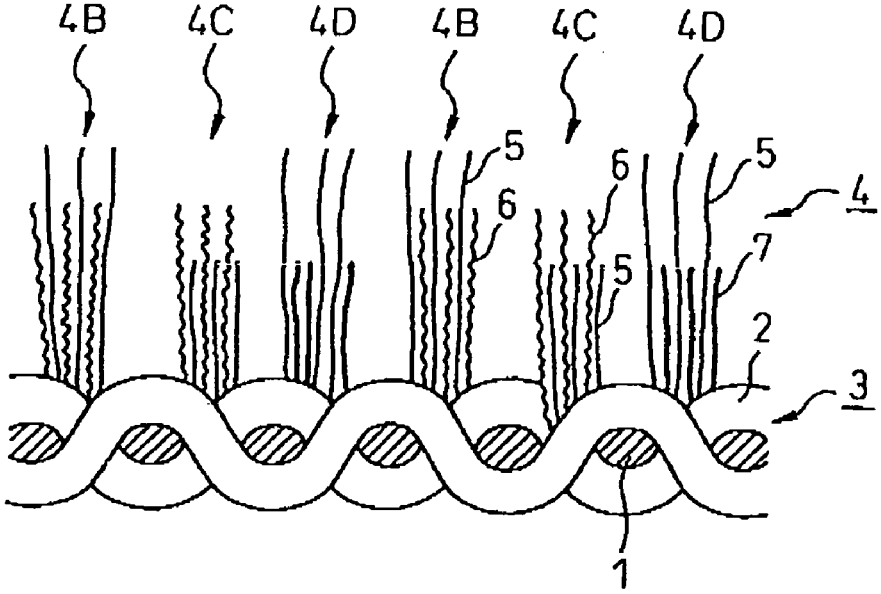
FIG. 2 shows an explanatory cross-sectional view of another embodiment of the multi-colored fiber pile fabric of the present invention.

A cross section of the above-mentioned another embodiment of the multi-colored fiber pile fabric is shown in FIG. 2. Referring to FIG. 2, a cut pile layer 4 is constituted from three different types of fiber piles 4B, 4C and 4D, each comprising a mixture of two different types of pile fibers. The mixed two type fiber piles 4B are constituted from two different types of fibers, namely the non-crimped pile fibers 5 and crimped pile fibers 6, the mixed two type fiber piles 4C are constituted from two different pile fibers, namely the crimped pile fibers 6 and crimped or non-crimped pile fibers 7, and the mixed two type fiber piles 4D are constituted from two different pile fibers, namely the non-crimped pile fibers 5 and the crimped or non-crimped pile fibers 7. In the pile fabric shown in FIG. 2, where at least one type of pile fibers selected from the pile fibers (1), (2) and (3) are different in hue and/or lightness from the others, the mixed colors of the cut piles 4B, 4C and 4D are different from each other, and the appearance color of the cut pile layer observed from above varies in dependence on the combinations of the two types of pile fibers contained in each of the cut piles. Accordingly, the cut pile layer shown in FIG. 2 exhibits complicated multi-colored patterns in response to the differences in pile height and color between the cut piles.

Figure 3:
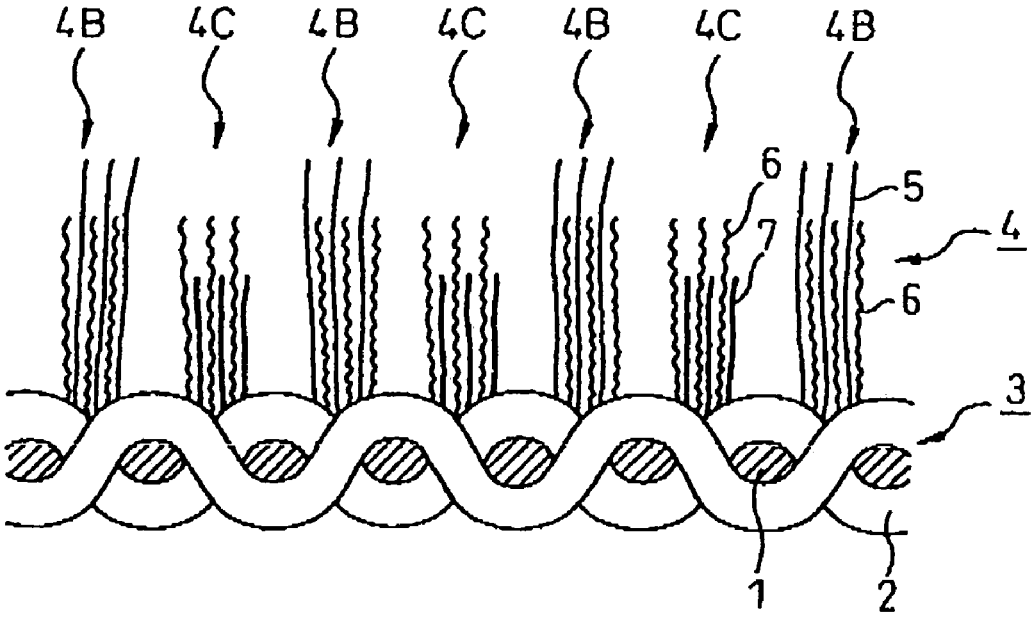
FIG. 3 shows an explanatory cross-sectional view of an embodiment of the concave-and convex-patterned multi-colored fiber pile fabric of the present invention.

FIG. 3 shows a cross-sectional profile of another example of the above-mentioned embodiment of the multi-colored fiber pile fabric. Referring to FIG. 3, a cut pile layer 4 is constituted from two types of mixed two type fiber pile 4B and 4C. The mixed two type fiber pile 4B is formed from non-crimped pile fibers 5 and crimped pile fibers 6, the other mixed two type fiber pile 4C is formed from the crimped pile fibers 6 and the crimped or non-crimped pile fiber 7. The combinations of the two types of mixed two type fiber piles include, in addition to the combination 4B+4C, a combination of mixed two type fiber piles 4B+4D (non-crimped pile fibers 5+crimped or non-crimped pile fibers 7) and a combination of piles 4C+4D.

In the embodiments of the pile fabric of the present invention shown in FIGS. 2 and 3, the combinations, mixing fiber mass ratio and mixing fiber number ratio of the two types of pile fibers from which each of the cut piles 4B, 4C and 4D is constituted, and the arrangement, pile number ratio, and pile mass ratio of the mixed two type fiber piles 4B, 4C and 4D can be appropriately established in response to the structure, color and pattern of the target pile fabric.

Namely, in each of the combinations of the above-mentioned mixed two type fiber piles, the appearance and patterns of the cut pile layer observed from above can be widely varied by varying the pile height, crimping degree, hue and lightness of the pile fibers from which the piles are formed.

In still another embodiment of the multi-colored pile fabric of the present invention, the cut pile layer comprises a plurality of non-crimped cut piles consisting of only the non-crimped pile fibers (1) (and having a heighest pile height), a plurality of crimped cut piles consisting of only the crimped pile fibers (and having a middle pile height), and a plurality of crimped or non-crimped cut piles consisting of only the crimped or non-crimped pile fibers (3) (and having a lowest pile height).

Figure 4:
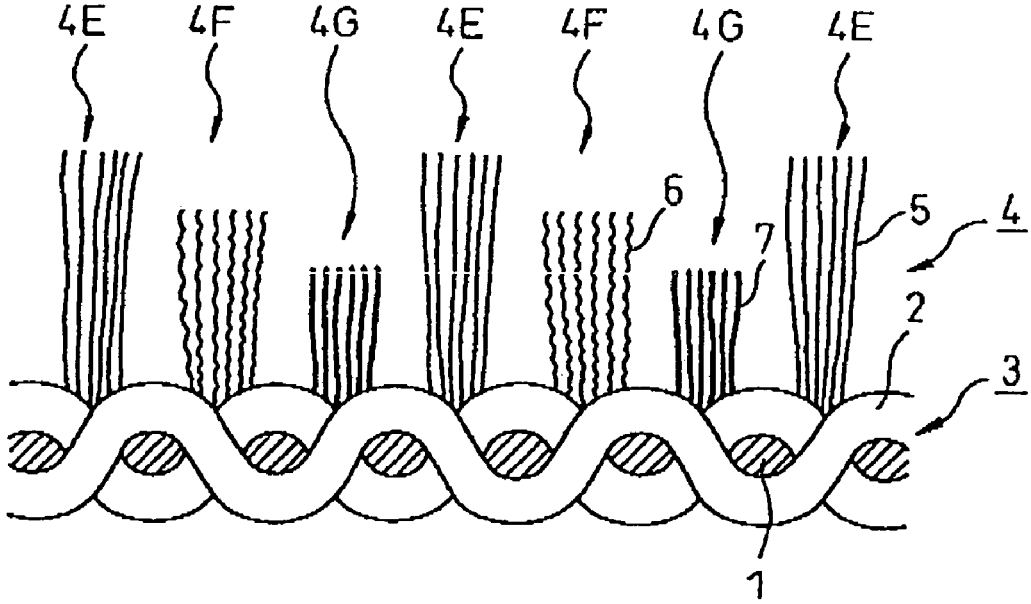
FIG. 4 shows an explanatory cross-sectional view of another embodiment of the concave-and convex-patterned multi-colored fiber pile fabric of the present invention.

In the explanatory cross-sectional profile of the still another embodiment of the multi-colored fiber pile fabric, as shown in FIG. 4, cut piles 4E consist of only non-crimped pile fibers 5, cut piles 4F consist of only crimped pile fibers 6 and cut piles 4G consist of only crimped or non-crimped pile fibers 7. In this type of cut pile layer formed from the cut piles different in pile height from each other, when observed from above, all of the cut piles 4E, 4F and 4G can be seen, or only the cut piles 4E and 4F can be seen, or only the cut piles 4E can be seen, by changing the observation angle and/or direction with respect to the cut pile fabric surface, and thus complicated multi-colored patterns are formed due to differences in pile height and hue of the fiber piles. The arrangement, mass ratio and cut pile number of the cut piles 4E, 4F and 4G can be appropriately established in response to the desired pattern of the cut pile fabric.

In the multi-colored fiber pile fabric of the present invention, the non-crimped pile fibers (1), the crimped pile fibers (2) and crimped or non-crimped pile fibers (3) are respectively and independently from each other selected from organic fibers, namely, organic natural fibers, organic synthetic fibers, organic semi-synthetic fibers and organic regenerated fibers. The organic natural fibers include cotton, wool and hemp fibers, etc. The organic regenerated fibers include viscose rayon fibers, the organic synthetic fibers include-polyester, nylon, and polyolefin fibers, etc, and the organic semi-synthetic fibers include cellulose acetate fibers, etc.

The non-crimped pile fibers (1) contained in the pile fabric of the present invention have a highest pile height and thus form a highest level of the cut pile layer, and thus are preferably formed from non-crimped polyester fibers having a high Young's modulus and a high resistance to flatting (being laid flat). When the pile fibers (1) are crimped fibers, the shielding effect of the resultant pile fibers on the crimped pile fibers (2) and the crimped or non-crimped pile fibers (2) increases, and thus the multi-coloring effect of the multi-colored pattern of the resultant cut pile fabric decreases.

The polyester fibers for the non-crimped pile fibers (1) are preferably selected from non-crimped polyethylene terephthalate fibers, non-crimped polybutylene terephthalate fibers, non-crimped polytetramethylene terephthalate fibers, and non-crimped polytrimethylene terephthalate fibers.

The crimped pile fibers (2) having a middle pile height are used to enhance the bulkiness and elastic modulus of compression of the cut piles or the cut pile layer, and the high bulkiness of the crimped pile fibers (2) causes the shielding effect of the non-crimped pile fibers (1) having a highest pile height to decrease and enables the degree of exposure of the crimped pile fibers (2) to the external appearance of the cut pile layer to enhance. The crimped pile fibers are not limited to specific types of fibers, as long as the fibers (2) have a necessary and sufficient degree of crimping. Preferably, the crimped pile fibers (2) are selected from crimped polyester filaments, crimped and modified polyester filaments dyeable with cationic dyes, and crimped nylon filaments, particularly cationic dye-dyeable crimped polyester filaments.

The above-mentioned crimped pile fibers (2) can be produced by applying an appropriate crimping procedure to the non-crimped fibers from which the target crimped fibers are formed. For example, for thermoplastic organic fibers, a false-twisting procedure, an air jet crimping procedure or a compressive crimping procedure can be applied.

The crimped or non-crimped pile fibers (3) having a lowest pile height may be crimped or non-crimped. The fibers for the-pile fibers (3) are preferably selected from organic fibers, more preferably from those useful for the non-crimped organic fibers, particularly polyester fibers.

The polyester resins for producing the polyester fibers appropriate to each of the pile fibers (1), (2) and (3) are produced from a dicarboxylic acid component and a diglycol component. Preferably, terephthalic acid is mostly employed for the dicarboxylic acid. Also, for the diglycol component, preferably at least one alkylene glycol selected from ethylene glycol, trimethylene glycol and tetramethylene glycol is mostly employed. Also, the polyester resins optionally contain third components in addition to the above-mentioned dicarboxylic acid and glycol components. As the third components, at least one member selected from cationic dye-dyeable anionic components, for example, sodium sulfoisophalate; other dicarboxylic acids than terephthalic acid, for example, isophthalic acid, naphthalene dicarboxylic acids, adipic acid and sebacic acid; other glycol compounds than alkylene glycols, for example, diethylene glycol, polyethylene glycol, bisphenol A and bis-phenolsulfone, may be employed.

Where the organic fibers for forming the pile fibers (1), (2) and/or (3) are man-made fibers, the polymeric material, from which the man-made fibers are produced, optionally contain at least one member selected from delustering agents (titanium dioxide), fine pore-forming agent (metal salts of organic sulfonic acids), coloring-preventive agents, thermal stabilizers, flame retardants (diantimony trioxide), fluorescent brightening agents, coloring pigments, anti-statics (metal salts of sulfonic acids), moisture-absorbing agents (polyoxyalkyleneglycol), anti-bacterial agents, inorganic particles, etc. Particularly, the coloring agents can impart a desired hue or lightness to the pile fibers (1), (2) and/or (3). Also, the delustering agents are effective to control the lightness of the pile fibers (1), (2) and/or (3).

In the multi-colored fiber pile fabric of the present intention, at least one type of fibers of the non-crimped pile fibers (l), the crimped pile fibers (2) and/or the crimped or non-crimped pile fibers (3) from which the cut pile layer is formed, must be different in lightness or hue or lightness and hue from other or others. The hue mentioned above include white, black and glay colors. The differences in lightness and hue between the pile fibers (1), (2) and (3) may be in an extent such that the differences are perceptible with the naked eye exhibiting a normal visual sensation, and the difference in the lightness is preferably 5 or more in terms of psychrometric lightness in the Munsell color system.

In the multi-colored fiber pile fabric of the present invention, the pile fibers (1), (2) and (3) may be the same in hue as each other and at least one type of pile fibers of the pile fibers (1), (2) and (3) may be different in lightness from others, or the pile fibers (1) (2) and (3) may be the same in lightness as each other and at least one type of pile fibers of the pile fibers (1), (2) and (3) are different only in the hue from others; or at least one type of pile fibers of the pile fibers (1), (2) and (3) are different in both the hue and the lightness from others.

To impart, to at least one type of pile fabric of the pile fibers (1), (2) and (3), a color different in lightness and/or hue from others, each group of the fibers of the pile fibers (1), (2) and (3) should be colored in a desired hue and lightness. For example, one or two types of the fibers of the pile fibers (1), (2) and (3) may be formed from a cationic dye-dyeable polyester resin and dyed in a color the same as others or different from others, in hue and/or lightness, and the remaining types of the fibers may be formed from a cationic dye-undyeable polyester resin colored or non-colored with a coloring pigment.

The cationic dye-dyeable polyester resins usable for the present invention may be selected from conventional cationic dye-dyeable polyester resins. For example, a cationic dye-dyeable polyester resin produced by using a dicarboxylic acid component containing, in addition to, for example, terephthalic acid, sodium sulfoisophthalate in an amount of 1.0 to 5.0 molar % based on the total molar amount of the dicarboxylic acid component, may be employed.

To impart, to at least one type of fibers of the pile fibers (1), (2) and (3), a lightness different from others, the type of pile fibers are formed from a copolymerized polyester resin produced by copolymerizing the above-mentioned usual (ordinary) dicarboxylic acid component and alkylene glycol component with a third copolymerization component comprising at least one compound selected from the other dicarboxylic acids than the usual (ordinary) dicarboxylic acid component, for example, naphthalene dicarboxylic acids, adipic acid and sebacic acid; and other glycol compounds than the usual alkylene glycol component, for example, diethylene glycol, polyethylene glycols, bis-phenol-A and bis-phenolsulfone; and the remaining type of pile fibers are formed from ordinary (regular) type of polyester resin.

By forming the pile fibers (1), (2) and (3) in the above-mentioned way, when the pile fibers (1), (2) and (3) are dyed altogether to the same hue as each other in a single disperse dye-dyeing both, the pile fibers made from the copolymerized polyester resin can be dyed in a higher color density (lower lightness) than that of the pile fibers made from the ordinary (regular) polyester resin.

In the multi-colored fiber pile fabric of the present invention, the non-crimped pile fibers (1), the crimped pile fibers (2) and the crimped or non-crimped pile fibers (3) are colored so that at least one type of the pile fibers of the above-mentioned pile fibers (1) to (3) have a color different in hue and/or lightness from the others. To impart, to each of the pile fibers (1), (2) and (3) a color different in hue and/or lightness from the others, for examples the non-crimped pile fibers (1) are formed from an ordinary (regular) polyester resin not modified and undyeable with the cationic dyes; the crimped pile fibers (2) are formed from a cationic dye-dyeable polyester copolymer resin; the crimped or non-crimped pile fibers are formed from a cationic dye-undyeable polyester copolymer resin (easy dyeable with disperse dyes); and the pile fibers (1), (2) and (3) are dyed altogether in a single dyeing both containing a cationic dye and a disperse dye in this case, the non-crimped pile fibers (1) and the crimped or non-crimped pile fibers (3) are dyed with the disperse dye into the same hue as each other, and the crimped pile fibers (2) are dyed with the cationic dye into a color the same or different in hue and/or lightness as or from the pile fibers (1) and (3). Also, in this case, the crimped or non-crimped pile fibers (3) are dyed with a higher color density (namely a lower lightness) than that of the non-crimped pile fibers (1). There are no limitations to the individual fiber thickness and the total thickness (yarn count) of the pile-forming yarn formed from the pile fibers (1), (2) and/or (3). Preferably, the individual fiber thickness of each of the pile fibers (1), (2) and (3) is in the range of from 0.1 to 10 dtex, and the total thickness of the above-mentioned pile-forming yarn is in the range of from 30 to 300 dtex. If the individual fiber thickness of each type of the pile fibers is less than 0.1 dtex, the resultant piles may exhibit an insufficient resistance to being laid flat, and the resultant pile layer may exhibit too low a soft hand. If the individual fiber thickness is more than 10 dtex, the resultant pile layer may exhibit too high a stiff hand. Also, if the total thickness of the pile-forming yarn is less than 30 dtex, the resultant pile layer may not provide a satisfactory multi-colored pattern. Also, the total yarn thickness is more than 300 dtex, the resultant pile-forming yarns may exhibit an insufficient handling property in yarn-processing procedures and knitting or weaving procedures. There is no limitation to the cross-sectional profiles of the individual fibers for the pile fibers (1), (2) and (3). Usually, the individual fibers in the pile fibers (1), (2) and (3) have a regular, namely circular or irregular, for example, triangular, flat, cross-formed, hexa-lobated or hollow cross-sectional profile.

There is no limitation to the knitting and weaving structures of the multi-colored fiber pile fabric of the present invention. The pile fabric of the present invention includes cut pile fabrics produced by cutting the loop piles of loop pile fabrics, for example, warp pile weaves, weft pile weaves, sinker pile knits, raschel pile knits and tricot pile knits.

In the multi-colored fiber pile fabric of the present invention, there is no specific limitation to the type of the yarns, the type of the fibers, the individual fiber thickness and the total yarn thickness of the ground structure portion. The ground structure portion can be formed from the yarns usable for the conventional pile fabric. Generally, the yarns for the ground structure portion of the pile fabric of the present invention are preferably selected from polyester multifilament yarns. The polyester multifilament yarns enable the resultant ground structure portion to exhibit a pleasant hand and a high dyeability.

The cut pile layer of the multi-colored fiber pile fabric of the present invention preferably has a contribution density of the pile fibers in the range of from 34,000 to 220,000 dtex/cm$^2$. If the pile fiber contribution density is less than 34,000 dtex/cm$^2$, the resultant cut pile layer may exhibit an insufficient resistance to flatting (being laid flat), of the pile fibers, especially in the case where the pile fabric is used as a cart sheet which is used under severe use conditions and thus in which the pile fibers may be significantly laid flat. Also, if the pile fiber contribution density is more than 220,000 dtex/cm$^2$, the resultant cut pile layer may exhibit too stiff a hand and may cause the production cost of the pile fabric to be too high.

The multi-colored fiber pile fabric of the present invention can be produced by, for example, the following procedures.

As fibers for forming the non-crimped pile fibers (1), non-crimped organic fibers, for example, non-crimped polyester filaments, having a shrinkage in boiling water (BWS) of 4% or less are preferably used.

If the shrinkage in boiling water (BWS) of the fibers for the non-crimped pile fibers (1) is more than 4%, and when the resultant pile fabric is subjected to a heat treatment, the heat treated pile fabric may exhibit too high a heat shrinkage, of the pile fibers, the resultant pile layer may exhibit an insufficient pile height of the non-crimped pile fibers in the pile layer and thus the multi-color pattern formed in the pile layer may be unsatisfactory. Also, when a etching treatment, which will be explained hereinafter, is locally applied to the cut pile layer, the resultant concave-and convex-pattern in the pile layer may be unsatisfactory.

In order to produce the organic fibers having a shrinkage in boiling water of 4% or less, an appropriate treatment for preventing the heat shrinking is applied to the non-crimped organic fibers. For example, polyester filaments are employed, preferably a dry heat treatment is applied at a temperature of 180 to 220° C. to a polyester filament yarn produced by usual filament-forming and drawing procedures.

The crimped pile fibers (2) usable for the multi-colored fiber pile fabric of the present invention are preferably selected from crimped organic fibers, for example, crimped polyester multifilaments, having a percentage crimp of preferably 8% or more, more preferably 10 to 30%. If the percentage crimp of the crimped organic fibers for forming the crimped pile fibers is less than 8%, and a cut pile layer is formed from the crimped organic fibers, particularly, the resultant cut pile layer is heat-treated, the crimped pile fibers in the cut pile layer may not exhibit sufficient bulkiness and resistance to compression. Also, in this case, the resultant pile fibers in the cut pile layer may have a pile height not sufficiently lower than that of the non-crimped pile fibers. If the percent crimp of the crimped organic fibers for forming the crimped pile fibers is more than 30%, in the resultant cut pile layer, particularly after a heat-treatment is applied to the cut pile layer, the crimped pile fibers (2) may exhibit an insufficient low pile height, and a balance in the pile height of the crimped pile fibers (2) with the non-crimped pile fibers (1) and the crimped or non-crimped pile fibers (3) may become inadequate, and thus a target multi-colored pattern of the cut pile layer may not be obtained. Also, in this case, when an etching treatment is applied locally to the resultant cut pile layer, a target concave-and convex-pattern may not be obtained on the etched pile layer.

As mentioned above, it is important that the percentage crimp of the crimped organic fibers for forming the crimped pile fibers (2) is established in response to processing conditions applied for the production of the desired pile fabric and, for example, to heat-treatment conditions applied to the cut pile layer formed through a cut pile layer-forming procedure, so that the pile height of the crimped pile fibers (2) comes into desired a level between the pile height of the non-crimped pile fibers (1) and that of the crimped or non-crimped pile fibers (3).

In the case where the crimped pile-fibers (2) are formed from false-twisted polyester filaments, a false-twisting procedure is applied to a the polyester filament yarn, while appropriately adjusting the false twisting conditions such as false twist factor and false twisting temperature to such an extent that the desired percentage crimp is attained.

The crimped or non-crimped organic fibers for forming the crimped or non-crimped pile fibers (3) are preferably selected from those having a shrinkage in boiling water (BWS) of 40 to 80%, and enabling the resultant pile fibers (3) obtained after the cut pile layer-forming and finishing procedures are applied to exhibit a desired pile height. In the case where polyester filaments are used as the organic fibers for forming the crimped or non-crimped pile fibers (3), such polyester filaments can be easily produced by the following procedures. Namely, a copolymerized polyester resin is prepared by copolymerizing a usual dicarboxylic acid component and a usual alkyleneglycol component together with a third component comprising at least one member selected from dicarboxylic acid components, for example, isophthalic acid, naphthalene dicarboxylic acids, adipic acid and sebacic acid; glycol compounds, for example, diethyleneglycol and polyethyleneglycol; and bis-phenol A and bisphenolsulfone, and is subjected to a filament-forming procedure; the resultant undrawn filament yarn is directly wound up, without drawing, at a winding speed of 3500 m/minute; the wound undrawn filament yarn are unwound and slightly drawn at a temperature of 60 to 80° C. at a draw ratio of 1.3 to 1.5.

The organic fibers for forming each of the pile fibers (1), (2) and (3) are used, to produce yarns for files optionally during being further drawn or after drawing, alone or in a mixture of two or three types of fibers with each other, in response to the structure of the target pile fabric, while being drawn or after drawing; the resultant fiber yarns are incorporated into the ground structure portion of the pile fabric by knitting or weaving procedure, to form a loop pile layer or at least one surface of the ground structure portion; and the loop piles are cut to convert them into cut piles.

For the mixing of the organic fibers, conventional doubling or paralleling method, interlace-mixing method using an interlace nozzle, double-twisting method, and electrostatically opening and mixing method. Among these fiber-mixing methods, the interlace-mixing method using the interlace nozzle is most appropriate for the formation of the pile yarns.

To form a cut pile layer having a knit structure, a ground structure is formed by a knitting procedure, and a loop pile structure, for example, a Sinker pile, pole tricot pile or double Raschel pile structure, is formed on the ground structure and then the resultant loop piles are cut.

The pole tricot piles is formed by converting the pile knit portion of the tricot knit structure to loop piles by using a raising machine.

To form a cut pile layer with a weave structure, a warp pile weave or a weft pile weave is produced by a weaving procedure, and cutting the resultant loop piles, or a moquet weave is produced and the pile yarns are cut at the center of each pile.

The pile fabric is optionally heat-treated. In the case where the cut pile layer includes polyester pile fibers, especially, the pile fibers (1), (2) and (3) are respectively constituted from non-crimped, low heat shrinkage polyester filaments, crimped polyester filaments and crimped or non-crimped, high heat shrinkage polyester filaments, a heat treatment is applied to the cut pile layer, so that the heat set crimped polyester filament (2) piles provide a desired middle pile height, the crimped or non-crimped high heat shrinkage polyester filament (3) piles are shrunk and provide a desired lowest pile height, and the non-crimped low heat shrinkage polyester filament (1) piles are maintained at the desired highest pile height.

When the heat treatment for the above-mentioned polyester filaments is carried out in accordance with a wet heating method, the heat treatment temperature is preferably in the range of from 80 to 130° C., more preferably 100 to 110° C. When the heat treatment is carried out in accordance with a dry heating method, the heat treatment temperature is preferably in the range of from 150 to 200° C., more preferably 160 to 180° C. If the wet heat treatment temperature is less than 80° C. or the dry heat treatment temperature is less than 150° C., the crimp-generation and the heat setting effect on the crimped polyester filaments (2) may be insufficient. Also, if the wet heat treatment temperature is more than 130° C. or the dry heat treatment temperature is more than 200° C., the elastic modulus of crimps of the crimped polyester filaments (2) may decrease, and/or the resultant pile fabric may, as a whole, excessively shrinks and exhibit a stiff hand.

The pile fabric, which has a cut pile layer and, optionally, has been heat-treated, is subjected to a usual pre-treatment and then to a dyeing treatment, to dye the pile fibers (1), (2) and (3) in a way such that at least one type of pile fibles of the pile fibers (1), (2) and (3) are dyed in a color different in hue and/or lightness from others. In the case where the pile fibers (1), (2) and (3) are respectively constituted from the non-crimped, low heat shrinkage polyester filaments, crimped, cationic dye-dyeable polyester filaments and crimped or non-crimped, high heat shrinkage polyester filaments, the resultant pile fabric is dyed in a dyeing both containing a disperse dye and a cationic dye so as to simultaneously dye the polyester filament piles (1), (2) and (3), to obtain a multi-colored fiber cut pile layer as mentioned above.

Alternatively, the non-crimped, low heat shrinkage polyester filaments (1) and the crimped or non-crimped, high heat shrinkage polyester filaments (3) are respectively produced from coloring pigment-containing polyester resins and the crimped polyester filaments (2) are produced from a cationic dye-dyeable polyester resin, the resultant pile fabric is subjected to a dyeing procedure using a cationic dye-containing dyeing both to selectively dye the crimped polyester filament piles (2) with the cationic dye, and to obtain a multi-colored fiber pile fabric.

The multi-colored pile fabric of the present invention has a cut pile layer in which the non-crimped pile fibers (1) having a highest pile height, the crimped pile fibers (2) having a middle pile height and the crimped or non-crimped pile fibers (3) having a lowest pile height are distributed in the way as shown in each of FIGS. 1 to 4. In the cut pile layer, the crimped pile fibers (2) has a high bulkiness caused by the crimps thereof and thus, when the crimped pile fibers (2) are distributed in the cut pile layer as shown in FIGS. 1 to 4, and the cut pile layer is observed from above, at least the non-crimped pile fibers (1) and the crimped pile fibers (2) appearing between the pile fibers (2) can be seen and, thereby, or by a combination of these pile fibers (1) and (2) and the knitting or weaving structures of the pile yarns, a sprinkled multi-colored pattern or a grandrelle multi-colored pattern is formed in the cut pile layer. Also, the crimped pile fibers (2) contribute to preventing the laying flat of the fiber piles, by utilizing the high crimping elasticity of the pile fibers (2).

An embodiment (1) of the concave-and convex-patterned multi-colored fiber pile fabric of the present invention is formed from the multi-colored fiber pile fabric of the present invention. In this embodiment (1), top portions of the non-crimped pile fibers (1) located in at least one partial region of the cut pile layer are removed by a chemical etching procedure to such an extent that the remaining non-crimped pile fibers (1-*a*) have a pile height controlled within the range of lower than that of the original non-crimped pile fibers (1) but not lower than that of the crimped pile fibers (2), to thereby form a concavity in a partial region and to increase the degree of exposure of the top portions of the crimped pile fibers (2) located in the concavity.

Figure 5:
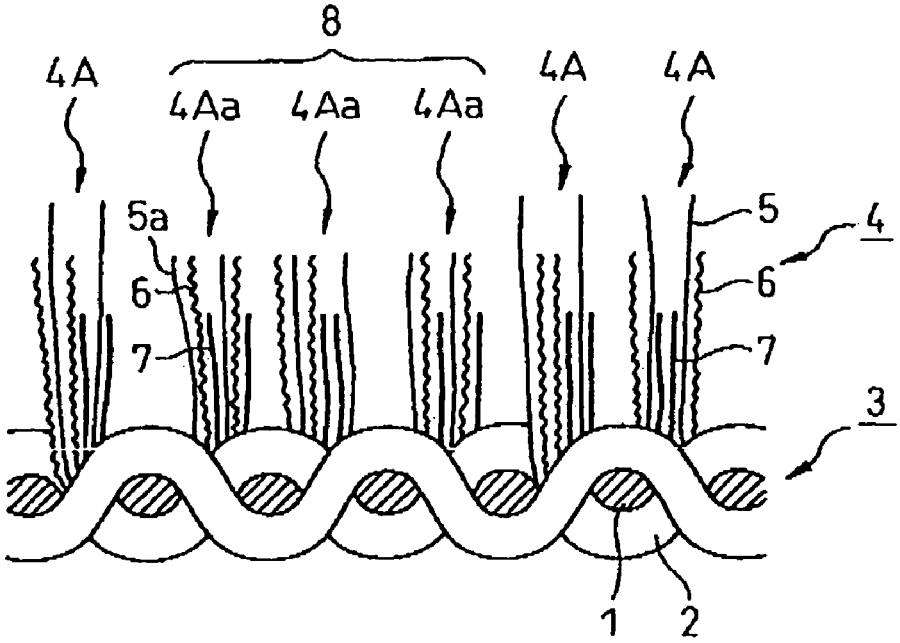
FIG. 5 shows an explanatory cross-sectional view of still another embodiment of the concave-and convex-patterned multi-colored fiber pile fabric of the present invention.

For example, in the explanatory cross-sectional profile of the multi-colored fiber pile fabric as shown in FIG. 5, the piles 4A, from which a cut pile layer 4 is formed, are each constituted from the non-crimped pile fibers 5, the crimped pile fibers 6 and crimped or non-crimped pile fibers 7 which three types of pile fibers are mixed with each other, in the same manner as shown in FIG. 1. In FIG. 5, in a partial region 8 of the cut pile layer 4, the pile heights of the crimped pile fibers 6 and the crimped or non-crimped pile fibers 7 in the piles 4Aa located in the partial region 8 are respectively the same as those in the pile 4A. However, top portions of the non-crimped pile fibers 5 are removed by a chemical etching procedure, and thus the resultant etched non-crimped pile fibers 5*a* have a pile height about the same as or higher than that of the crimped pile fibers 6. Thus, the partial region 8 forms a concave in the cut pile layer 4. Also, in the cut piles 4Aa in the partial region 8, the etched non-crimping pile fibers Sara has a pile height lower than the non-etched non-crimped pile fibers 5, and thus the degree of shielding for the crimped pile fibers 6 and the crimped or non-crimped pile fibers 7 by the etched non-crimped pile fibers 5*a* is lower than that by the non-etched non-crimped pile fibers 5 in the cut piles 4A. In other words, the degree of exposure of the pile fibers 6 and 7 in the cut piles 4Aa is higher than that in the cut piles 4A, and thus the color appearance of the cut piles 4Aa is different from that of the cut piles 4A. Accordingly, the partial region 8 becomes different not only in the formation of a concavity but also in the color appearance (pattern) from the region surrounding the partial region 8, and thus the cut pile layer 4 exhibits, as a whole, a combination of the concave-and convex-pattern with the color pattern.

Another embodiment (2) of the concave-and convex-patterned multi-colored fiber pile fabric of the present invention is formed from the multi-colored fiber pile fabric of the present invention. This embodiment (2) is characterized in that in at least one partial region of the cut pile layer, top portions of the non-crimped pile fibers (1) and top portions of the crimped pile fibers (2) are removed by a chemical etching procedure to such an extent that the remaining non-crimped pile fibers (1-*a*) and the remaining crimped pile fibers (2-*a*) have pile heights controlled within the range of lower than that of the original non-crimped pile fibers (1) but not lower than that of the crimped or non-crimped pile fibers (3), to thereby increase the degree of exposure of the top portions of the remaining crimped pile fibers (2-*a*) and the crimped or non-crimped pile fibers (3) located in the partial region.

Figure 6:
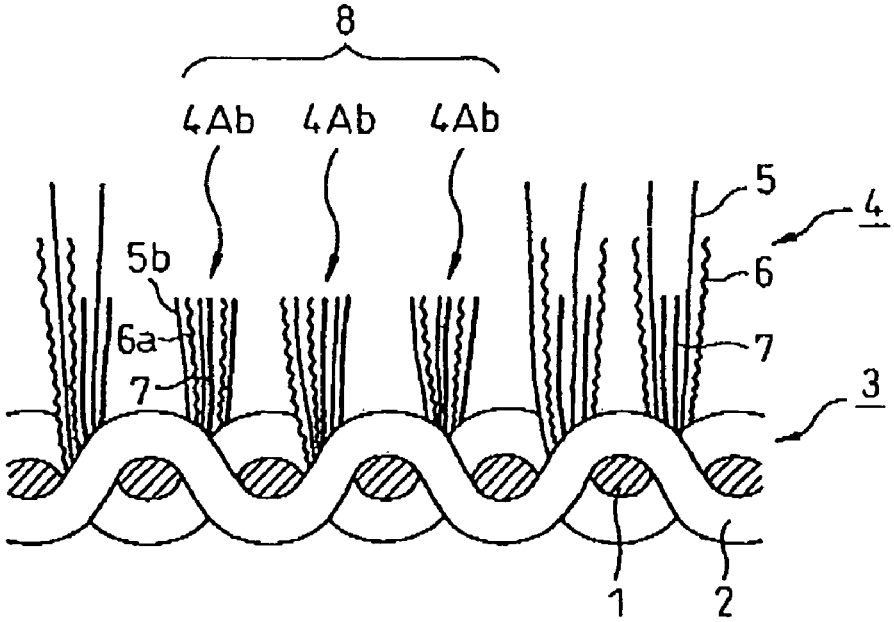
FIG. 6 shows an explanatory cross-sectional view of further embodiment of the concave-and convex-patterned multi-colored fiber pile fabric of the present invention.

For example, in FIG. 6, a cross-sectional profile of another embodiment of the concave-and convex-patterned multi-colored fiber pile fabric is shown. In the pile fabric shown in FIG. 6, a concave 8 is formed by removing top portions of the non-crimped pile fibers 5 and the crimped pile fibers 6 located in a partial region 8 in the same cut pile layer 4 as that shown in FIG. 1, by a chemical etching procedure so that the pile heights of the etched pile fibers become to about the same at that of the crimped or non-crimped pile fibers 7, and thus the degrees of exposure of the etched pile fibers 6*a* and 7 in the cut pile 4Ab become higher than that of the pile fibers 6 and 7 in the cut piles 4 shown in FIG. 1, and the degree of exposure of the pile fibers 7 becomes higher than that of the pile fibers 7 in the cut piles 4Aa shown in FIG. 5. Accordingly, in the pile layer shown in FIG. 6, the partial region 8 exhibit, together with the portions of the pile layers surrounding the partial region 8, a concave-and convex-pattern, and the color pattern of the cut pile 4Ab in the partial region 8 is different from that of the cut piles 4A shown in FIG. 1 and the cut piles 4Aa shown in FIG. 5.

In the pile fabric shown in each of FIGS. 2 and 3, a pile fabric having a composite pattern formed from a concave-and convex-pattern and a color pattern can be obtained by removing top portions of the non-crimped pile fibers 7 in the cut pile fibers 4B and 4D located in the partial region by a chemical etching procedure, to such an extent that the remaining pile fibers exhibit a pile height approximately the same as or slightly higher than the pile height of the crimped pile fibers 6; or by removing top portions of the non-crimped pile fibers 5 and the crimped pile fibers 6 in the cut piles 4B, 4C and 4D by a chemical etching procedure, to such an extent that the remaining pile fibers exhibit a pile height approximately the same as or slightly higher than that of the crimped or non-crimped pile fibers 7.

Figure 7:
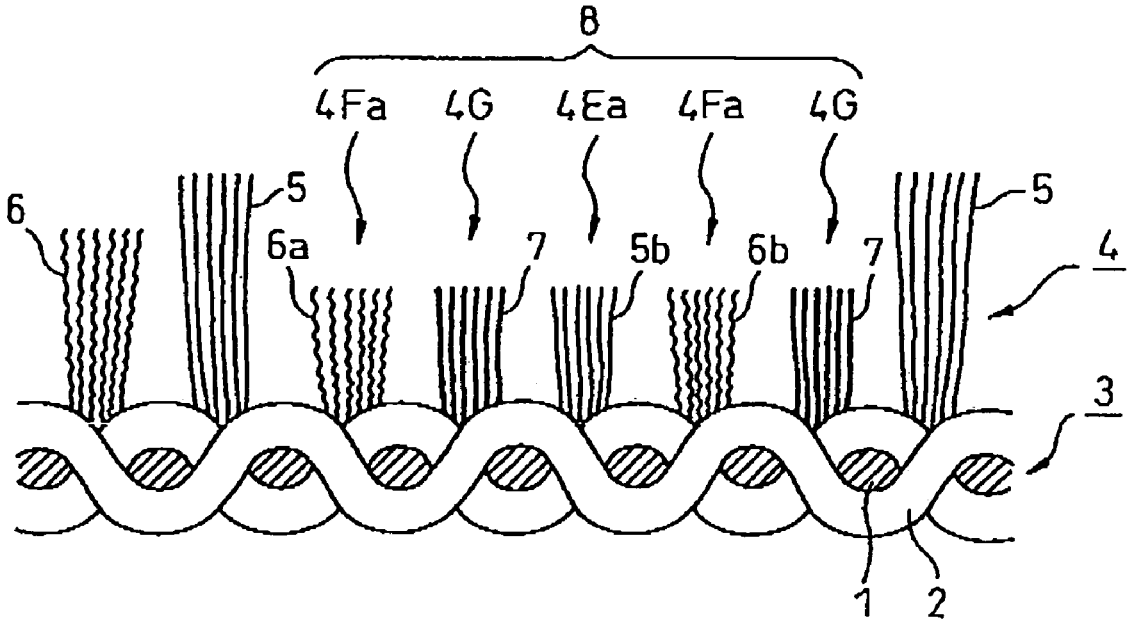
FIG. 7 shows an explanatory cross-sectional view of still further embodiment of the concave-and convex-patterned multi-colored fiber pile fabric of the present invention.

In the pile fabric shown in FIG. 7, a concavity is formed in a partial region 8 of the pile fabric having the same constitution as that of the pile fabric shown in FIG. 4. In the concave region 8, a chemical etching procedure is applied to top portions of the non-crimped pile fibers 5 and the crimped pile fibers 6 to remove the top portions to such an extent that the pile heights of the etched non-crimped pile fibers 5 and the etched crimped pile fibers 6 become approximately the same as or slightly higher than that of the crimped or non-crimped pile fibers 7, to form cut piles 4Ea formed from the etched non-crimped pile fibers 5*b* and cut piles 4Fa formed from the etched crimped pile fibers 6*a*, and thereby to provide with a color pattern formed from the above-mentioned cut piles 4Ea and 4Fa and cut piles 4G formed from the crimped or non-crimped pile fibers 7. In this color pattern, the etched pile fibers 5 and 6 having a decreased pile height causes the degrees of exposure of the cut piles 4Ta and 4G to increase. Therefore, the color pattern of the concave region 8 shown in FIG. 7 is different from the color pattern of the pile fabric shown in FIG. 4, namely of the portions of the pile fabric surrounding the concave region 8. Accordingly, the formation of the concave region 8 enables a complicated pattern to be formed from a combination of the concave- and convex-pattern with the color pattern.

There is no limitation to the structure of the fabric material for the cut pile fabric of the present invention, and the structure may be appropriately established. As a fabric material for the cut pile fabric of the present invention, a loop pile fabric can be produced as follows. Namely, a knitted or woven fabric having a desired knitting or weaving structure is produced from multi-filament yarns or spun yarns for a ground structure portion and at least one type of filament yarns for forming piles having a desired fiber structure, in the resultant loop pile fabric is subjected to a loop pile-cutting procedure, to provide a cut pile fabric and then the resultant cut pile fabric is subjected to appropriate processing procedures to thereby form pile fibers (1), (2) and (3) each having a desired pile height.

Figure 8:
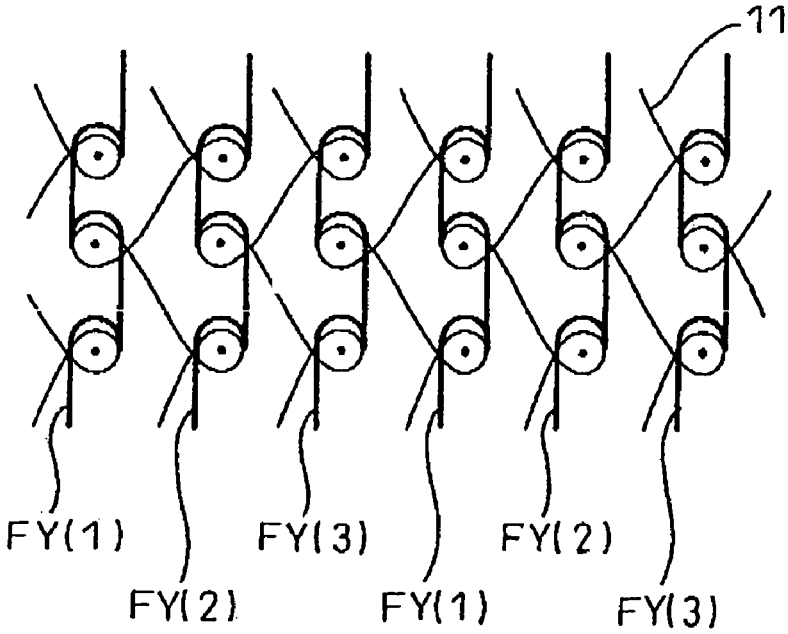
FIG. 8 shows a knitting structure of an embodiment of a multi-colored fiber pile knitted fabric of the present invention.

To produce a pile knitted fabric having three types piles (1), (2) and (3) different in composition of the pile fibers from each other, as a material fabric, a loop pile knitted fabric is produced from, for example, yarns 11 for forming a ground structure portion, filament yarns FY(1) for forming piles (1) (for example, piles consisting of non-crimped pile fibers (1) only), filament yarns FY(2) for forming piles (2) (for example, piles consisting of crimped pile fibers (2) only) and filament yarns FY(3) for forming piles (3) (for example, piles consisting of crimped or non-crimped pile fibers (3) only), in accordance with the knitting structure as shown, for example, in FIG. 8.

To form the concave-and convex-pattern in the pile fabric of the present invention, a chemical etching procedure is applied by bringing a chemical etching agent into contact with top portions of the non-crimped pile fibers (1) or the non-crimped pile fibers (1) and the crimped pile fibers (2) located in partial regions of the cut pile layer corresponding to a predetermined pattern. For example, in the case where the pile fibers are polyester fibers or polyamide fibers, the chemical etching procedure is carried out by bringing an aqueous sodium hydroxide solution having a concentration of 25 to 40% by mass into contact with the pile fibers of the pile fabric and then heating the pile fabric with steam.

EXAMPLE

The present invention will be further illustrated by the following examples which are not intended to restrict the scope of the present invention in any way.

The products and the material yarns of the examples and comparative examples were subjected to the following tests and evaluations in the terms and by the measurement methods shown below.

(1) Shrinkage in Boiling Water (BWS)

A sample of a filament yarn to be tested was wound 10 times around a sizing reel having a periphery length of 1.125 m, to provide a hank. The hank was hung from a hanging hook on a scale board, a load corresponding to 1/30 of the total mass of the hank was applied to the lower end of the suspending hank, and a length L1 of the hank before shrinking treatment was measured.

The applied load was removed from the hank, the hank was placed in a cotton bag, the bag containing the hank was immersed in boiling water for 30 minutes to allow the hank to freely shrink. The bag was removed from boiling water, the hank was taken out from the bag, water around the hank yarn was removed by absorbing with filter paper sheets, and the hank was dried at room temperature for 24 hours. The dried hank was hung from the hook on the scale board, a load corresponding to 1/30 of the total mass of the hank was applied to the lower end of the suspending hank, in the same manner as mentioned above, and the length L2 of the hank after the shrinking treatment was measured.

The shrinkage of the tested filament yarn in boiling water (BWS) was calculated in accordance with the following equation.

$$BWS(\%)=[(L1-L2)/L1]\times 100$$

(2) Percentage Crimp

A hank of the filament yarn to be tested having a dry thickness of 2333 dtex was prepared by winding the filament yarn around a sizing reel having a periphery length of 1.125 m.

The hank was hung from a hook on a scale board, an initial load of 6 g was applied to the lower end of the suspending hank, then an additional load of 600 g was applied to the lower end of the hank and the length L0 of the hank under load was measured. Immediately after the measurement, the loads were removed from the hank, and the hank was taken off the hook of the scale board, and was immersed in boiling water for 30 minutes to allow the hank to freely shrink. The boiling water-treated hank was taken out from boiling water, water around the hank yarn was removed by absorbing with filter paper sheets, then the hank was dried at room temperature for 24 hours.

The dried hank was hung from the hook on the scale board, a load of 600 g was applied to the lower end of the suspending hank, one minute after the hanging, the length L1*a* of the hank was measured, the load was removed from the hank, one minute after the removal of the load, the length L2*a* of the hank was measured.

The percentage crimp (CP) of the filament yarn was calculated in accordance with the following equation.

$$CP(\%)=[(L1a-L2a)/L0]\times 100$$

(3) Lightness

The lightness of a pile fabric was measured in accordance with the Munsell color system (JIS Z 8721).

(4) Resistance of Piles to Laying Flat

A weight in a cylindrical form having a diameter of 4 cm and a mass of 500 g was placed on a center portion of a specimen (dimensions: 10 cm×10 cm) of a pile fabric, and the weighted pile fabric was stored in a constant temperature container at a temperature of 80° C. for 2 hours. Thereafter, the weight was removed from the pile fabric and then the fabric was left standing under no stretch condition at room temperature for 30 minutes.

Thereafter, a difference in pile-laying flat condition between the portion of the pile fabric on which the weight was placed and another portion of the file fabric surrounding the weight-placed portion was observed with the naked eye and evaluated into the following five classes.

| Class | Pile-laying flat condition |
|---|---|
| 5 | No pile-laying flat is found.<br>Usable in practice |

-continued

| Class | Pile-laying flat condition |
|---|---|
| 4 | Slight pile-laying flat is found.<br>Usable in practice |
| 3 | Moderate pile-laying flat is found. |
| 2 | Rather significant pile-laying flat is found. |
| 1 | Pile-laying flat is completed. |

(5) Evaluation of Multi-colored, Concave-and Convex-pattern of Pile Fabric

The multi-colored, concave-and convex-pattern appearing in the pile fabric was evaluated by the naked eye into the following three classes.

| Class | Multi-colored, concave-and convex-pattern |
|---|---|
| 3 | Good |
| 2 | Practically usable |
| 1 | Bad |

Example 1

A polyethylene terephthalate multifilament yarn (yarn count: 84 dtex/36 filaments) was heat-treated under treating conditions, namely a heater length of 2 m, a heat treatment temperature of 200° C., a heat-treatment speed of 500 m/min. and a overfeed percentage of 5%.

The resultant non-crimped polyester filament yarn (1) exhibited a shrinkage in boiling water of 1.2%.

Separately, a cationic dye-dyeable polyester was produced in such a manner that, in the production of polyethylene terephthalate by a polycondensation procedure, the acid component contained sodium sulfoisophthalic acid in an amount of 2.6 molar %, based on the total molar amount of the acid component, to copolymerize the cationic compound into the polyethylene terephthalate. From the resultant cationic dye-dyeable polyester, a crimped polyester filament yarn (2) having a yarn count of 100 dtex/24 filaments, and a crimp percentage of 21% realized by a false-twisting procedure, was produced.

Further separately, a copolymerized polyester having a relative viscosity of 1.45 was produced from an acid component comprising terephthalic acid and isophthalic acid in a molar ratio of 93/7 and a glycol component comprising ethyleneglycol. The resultant copolyester resin was subjected to a melt-spinning procedure and the resultant filaments were wound-up at a winding-up speed of 3500 m/min., to produce a partially oriented, undrawn copolyester multifilament yarn. The undrawn multifilament yarn was drawn at a draw ratio of 1.4, without heat-setting, between a first roller having a temperature of 15° C. and a second roller having a temperature of 75° C. of a drawing apparatus, to produce a non-crimped copolyester filament yarn (yarn count: 100 dtex/12 filaments). The resultant non-crimped copolyester filament yarn exhibited a shrinkage in boiling water (BWS) of 65%.

One of the non-crimped polyester filament yarns (1), one of the crimped cationic dye-dyeable polyester filament yarns (2) and one of the non-crimped copolyester filament yarns (3) are made parallel to each other, the resultant parallel yarn was fed into a interlacing nozzle of an interlace apparatus and the individual filaments in the parallel yarn were mixed at an overfeed rate of 3%, at a yarn speed of 400 m/min. The resultant filament mixed yarn consisting of three different types of filaments was used as a pile-forming yarn of a pile fabric. Also, non-crimped polyethylene terephthalate filament yarns having a yarn count of 167 dtex/48 filaments were used as a yarn for forming a ground structure portion of the pile fabric.

The above mentioned filament yarns were fed to all the reeds of a warp-knitting machine (made by KARL MAYER CO.) provided with 28 gauge ball sinker, to produce a loop pile fabric having the following structures Ground structure:

Courses: 23.6 yarns/cm

Wales: 11.1 yarns/cm

Pile structure: Loop pile length: 2.5 mm

The resultant loop pile fabric was subjected to a shearing procedure using a shearing machine (made by Nikki K.K.) to cut the pop portion of the loop piles at 0.2 mm, and to convert the loop piles to cut piles. The resultant cut pile fabric was subjected in an opened form to a dry heat-setting procedure using a dry heat-setter at a temperature of 180° C. for 45 seconds, to stabilize in dimension the non-crimped polyester filaments (1), to fully complete the crimping of the cationic dye-dyeable polyester filaments (2) and to fully heat shrink the non-crimped copolyester filaments (3). The resultant cut pile fabric had a basis mass of 100 g/m$^2$.

The cut pile fabric was subjected to a dyeing procedure using a dyeing both containing the dye composition shown below.

| | |
|---|---|
| Teratop Pink 2GLA (trademark, made by Ciba-Gaygy) | 1.8% (based on the fabric mass) |
| Teratop Blue HLB (trademark, made by Ciba-Geigy) | 0.4% (based on the fabric mass) |
| Bismarck Brown B (trademark, made by NIHON KAGAKU K.K.) | 3.5% (based on the fabric mass) |
| Irgasol DAM (trademark, made by Ciba-Geigy) | 1 g/liter |
| Acetic acid | 0.5 g/liter |

The dyeing procedure was carried out in a liquid stream dyeing machine (made by HISAKA SEISAKUSHO), at a temperature of 130° C. for 45 minutes.

By the above-mentioned dyeing procedure, the crimped cationic dye-dyeable polyester filaments (2) were dyed in a brown color (at a lightness of 50), the non-crimped copolyester filaments (3) were dyed in a purplish red color (at a lightness of 43) and the non-crimped polyester filaments were dyed in a light purplish pink color (at a lightness of 65).

The dyed cut pile fabric was dried by using a short loop dryer (made by HIRANO TEXEED K.K.) at a temperature of 120° C. for 2 minutes. The dried cut pile fabric was subjected to a heat treatment using a dry heat setter (made by HIRANO TEXEED) at a temperature of 160° C. for one minute, while removing winkles from the fabric In each cut pile in the resultant cut pile fabric, non-crimped pile fibers (1) having a highest pile height were formed from the non-crimped polyester filaments (1), crimped pile fibers (2) having a middle pile height were formed from the cationic dye-dyeable polyester filaments (2) and non-crimped pile fibers (3) having lowest pile height were formed from the non-crimped copolyester filaments (3).

Then, a concave-and convex-pattern-forming treatment was applied to the cut pile layer of the above-mentioned cut pile fabric, by the following procedures.

A printing screen frame A was prepared by forming dye paste-permeating portions in a pattern of light blue spots in a mesh fabric #700 having a permeability of 30%, for screen printing. Separately, a printing screen frame B was prepared by forming dye paste-permeating portions in a pattern of light blue spots, which patterns are superposed on the pattern in the frame (A), in a mesh fabric #700 having a permeability of 80% for screen printing.

An alkali paste for etching was prepared by dissolving an aqueous sodium hydroxide solution having a concentration of 269.4 g/litter (Baumé degree of 28) and a size for etching agent (trademark; Cebtex T-36, made by SHOEI RIKEN K.K.) in water at room temperature to provide an alkali size for etching having a solid concentration of 35.5% by mass and a viscosity of 4 Pa·s (4000 cP). The alkali size for etching was printed in the pattern of light blue spots on the cut pile layer surface of the cut pile fabric, through the printing screen frames A and B with the printing pattern of light blue spots. The printed alkali size was dried at a temperature of 140° C. for 10 minutes, and steam-treated with saturated steam at a temperature of 170° C. for 15 minutes. On the cut pile layer, in the printed portions in the light blue spot pattern through the printing screen frame A (namely in the first light blue spot pattern-printed portions), top portions of the non-crimped polyester pile fibers (1) are removed to such an extend the remaining (non-top removed) pile fibers (1) had a pile height equal to that of the crimped cationic dye-dyeable polyester pile fibers (2), and in the printed portions in the light blue spot pattern through the printing screen frame B (namely, in the second light blue spot pattern-printed portions), top portions of the non-crimped polyester pile fibers (1) and the crimped cationic dye-dyeable polyester pile fibers were removed to such an extent that the remaining (non-top removed) pile fibers (1) and (2) have a pile height equal to that of the non-crimped copolyester pile fibers (3). Namely, the first light blue spot-patterned portions in the cut pile layer form small depth concavities and in the portions, the top portions of the non-crimped pile fibers (1) and the crimped pile fibers (2) are exposed outside. Also, the second light blue spot-patterned portions in the cut pile layer form large depth concavities and in the portions, all the three colors of the non-crimped pile fibers (1), crimped pile fibers (2) and non-crimped pile fibers (3) are exposed. In other portions of the cut pile layer surrounding the first and second light blue-patterned portions, the crimped pile fibers (2) are shielded by the non-crimped pile fibers (1) and the non-crimped pile fibers (3) are shielded by the non-crimped pile fibers (1) and the crimped pile fibers (2), and thus in the appearance of the cut pile layer observed from above, portions of the crimped pile fibers (2) are seen in a sprinkled color pattern (a pepper-in-salt-like color pattern) through a matrix consisting of the non-crimped pile fibers (1), and the non-crimped pile fibers (3) are slightly and sprinkly seen through non-crimped pile fibers (1) and (2). Accordingly, in the resultant pile fabric with the concave-and convex-pattern; a concave-and convex-pattern formed from the small depth concave portions, the large depth concave portions and the portions surrounding the concave portions, is combined with a color pattern formed from the small depth concavity portions, the large depth concave portions and portions surrounding the concave portions, which are different in the degree of exposure to the three types of pile fibers different in hue and/or lightness from each other and located in the above-mentioned portions.

The test results are shown in Table 1.

Example 2

A concave-and convex-patterned multi-colored fiber pile fabric was produced by the same procedures as in Example 1 with the following exceptions.

As filament yarns for forming the non-crimped pile fibers (1), non-crimped polyester (polyethylene terephthalate) filaments (1) formed from a resin colored with a black-coloring pigment and having a yarn count of. 75 dtex/36 yarns were employed. The filaments (1) exhibited a shrinkage in water of 1.2%.

Also, in the dyeing procedure, the dyeing both contained no Teratop Pink 2GLA and no Teratop Blue HLB. Thus, in the cut pile layer, the crimped cationic dye-dyeable polyester filaments (2) were dyed in a brown color and the dyed color was different in hue and lightness from the black color of the non-crimped polyester filaments (1). Further, the non-crimped copolyester filaments (3) were not colored by the dyeing procedure.

In the chemically etched cut pile fabric, a concave-and convex-pattern was formed from large depth concavities and small depth concavities. The appearance of portions of the pile layer surrounding the concave portions is formed from the non-crimped pile fibers (2) colored in a black color with-the black coloring pigment and having a highest pile height, the brown-colored crimped pile fibers (2) partially seen through the crimped pile fibers (1) shielding the pile fibers (2) and the non-colored non-crimped pile fibers slightly seen in a-sprinkled color pattern (a pepper-in-salt-like color pattern) through the pile fibers (1) and (2) shielding the pile fibers (3). In the appearance of the small depth concave portions of the pile layer, the degrees of exposure of the brown-colored crimped pile fibers (2) and the non-colored non-crimped pile fibers was higher than that in the-surrounding portions. In the appearance of the large depth concave portion of the pile layer, the degrees of exposure-of the pile fibers (2) and (3) were further increased. Thus, the appearances of the concave-surrounding portions, the small depth concave portions and the large depth concave portions were different in color pattern from each other.

The test results are shown in Table 1.

Example 3

A concave-and convex-patterned multi-colored fiber pile fabric was produced by the same manner as in Example 1, with the following exceptions.

Three types of pile-forming filament yarns (1), (2) and (3) each having a total thickness of 284 dtex were respectively prepared from the polyester (PET) filaments (1) for the non-crimped pile fibers (1), the cationic dye-dyeable polyester filaments (2) for the crimped pile fibers (2) and non-crimped copolyester filaments (3) for the non-crimped pile fibers (3).

The filament yarns (1), (2) and (3) for forming the pile layer and the same polyester filament yarn as in Example 1 for forming the ground structure portion were subjected to a knitting procedure in the knitting structure shown in FIG. 8, to produce a pile fabric. In the resultant pile fabric, a combination of a light purplish red-colored pile ridge consisting of non-crimped polyester pile fibers (1) and having a highest pile height and a high lightness; a brown-colored pile ridge consisting of the crimped cationic dye-dyeable polyester pile fibers (2) and having a middle pile height; and a purplish red-colored pile ridge consisting of the non-crimped copolyester pile fibers (3) having a lowest pile height and a moderate lightness, each ridge extending in the course direction of the pile fabric, were repeatedly arranged in the wale directions.

The cut pile layer was subjected to the same chemical etching procedure with alkali as in Example 1, to form the small depth concave portions and the large depth concave portions in the light blue spot pattern. The concavity-surrounding portions of the resultant cut pile layer have a combination of the light purplish red-colored cut pile ridges of the pile fibers (1), the brown-colored cut pile ridges of the pile fibers (2), and the pile ridges of the pile fibers (3) having a darker purplished red color than that of the pile fibers (1), and the pile ridges formed from the pile fibers (1) and having a highest pile height partially shield the pile ridges formed from each of the pile fibers (2) and (3) and having a lower pile height than that of the pile fibers (1).

Also, in the small depth concave portions, the degree of exposure of the pile ridges formed from the pile fibers (2) (brown-colored) was higher than that in the concavity-surrounding portions. In the large depth concave portions, the degree of exposure of the pile fibers (3) (colored in a relatively dark purplish red color) was higher than that in the small depth concave portions.

The test results are shown in Table 1.

Example 4

A concave-and convex-patterned multi-colored fiber pile fabric was produced by the same manner as in Example 1, with the following exceptions.

The crimped cationic dye-dyeable polyester filament yarns used as the crimped pile fiber (2)-forming filaments (2) were replaced by crimped nylon 66 filament yarns (having a yarn count of 78 dtex/34 filaments, and a percentage crimp of 15%).

Also, in the dyeing both, Bismarck Brown B was replaced by Sumitomo Fast Yellow EGG (trademark, made by SUMITOMO KAGAKUKOGYO K.K.) in an amount of 3% by mass based on the mass of the yarn), and the dyeing both temperature was changed to 120° C. The crimped nylon filaments (2) were dyed in yellow color.

The test results are shown in Table 1.

Comparative Example 1

A concave-and convex-patterned multi-colored fiber pile fabric was produced by the same manner as in Example 1, with the following exceptions.

The crimped cationic dye-dyeable polyester filament yarns for forming the crimped pile fibers (2) were replaced by non-crimped filament yarns comprising the same cationic dye-dyeable polyester as used in Example 1, having a shrinkage in boiling water of 5% and a yarn count of 100 dtex/24 filaments. In the resultant cut pile fabric before applying the etching procedure, the pile fibers (1) and the comparative pile fibers were both formed from non-crimped filament yarns and have approximately the same pile height from each other, and therefore exhibited insufficient bulkiness. Also, the resultant multi-color pattern of the cut pile layer was unsatisfactory. Further, after the small depth concave portions and the large depth concave portions were formed by the alkali-etching treatment, the absence of the crimped pile fibers caused the resultant concave-and convex-pattern and the color pattern were both unsatisfactory. Also, the resultant cut pile layer exhibited an insufficient resistance, of the file fibers, to laying flat.

The test results are shown in Table 1.

Comparative Example 2

A concave-and convex-patterned multi-colored fiber pile fabric was produced by the same manner as in Example 1, with the following exceptions.

The cationic dye-dyeable polyester filament yarns for the crimped pile fibers (2) were replaced by crimped filament yarns having a shrinkage of 20% and comprising the same polyester (PET) resin as that of the polyester filament yarns for the non-crimped pile fibers (1).

The resultant pile fabric exhibited a high resistance of the pile fibers to laying flat. However, as the pile fibers (1) and the pile fibers (2) exhibited the same hue and the same lightness as each other, the resultant multi-color pattern was unsatisfactory.

TABLE 1

| | | Example No | | | | | |
|---|---|---|---|---|---|---|---|
| | | Example | | | | Comparative Example | |
| Item | | 1 | 2 | 3 | 4 | 1 | 2 |
| Shrinkage (%) in boiling water of filaments for non-crimped pile fibers (1) | | 1.2 | 1.2 | 1.2 | 1.2 | 1.2 | 1.2 |
| Percentage crimp (%) of filaments of crimped pile fibers (2) | | 21 | 21 | 21 | 15 | None | 20 |
| Shrinkage (%) in boiling water of filaments for crimped or non-crimped pile fibers (3) | | 65 | 65 | 65 | 65 | 65 | 65 |
| Hue and lightness | None-crimped pile fibers (1) | Light purplish red | Black | Light purplish red | Light purplish red | Light purplish red | Light purplish red |
| | | 65 | 12 | 65 | 65 | 65 | 69 |
| | Crimped pile fibers (2) | Brown | Brown | Brown | Yellow | Brown | Light purplish red |
| | | 50 | 50 | 50 | 73 | 50 | 67 |
| | Crimped or non-crimped pile fibers (3) | Purplish red | White | Purplish red | Purplish red | Purplish red | Purplish red |
| | | 43 | 88 | 43 | 43 | 43 | 50 |
| Resistance of pile fibers in cut pile layer (class) | | 4 | 4 | 4 | 4 | 2 | 4 |
| Appearance of cut pile layer (class) | | 4 | 4 | 4 | 3 | 2 | 1 |

Industrial Applicability

The multi-colored fiber pile fabric of the present invention exhibits an excellent resistance of pile fibers to laying flat and a preferable multi-colored pattern and thus has a high industrial applicability.

Also, the concave-and convex-patterned multi-colored fiber pile fabric of the present invention has an excellent resistance of the pile fibers to laying flat and a pleasant combination of the multicolor pattern and the concave-and convex-pattern and exhibit a high practical utilizability.

The invention claimed is:

1. A concave-and convex-patterned multi-colored fiber pile fabric produced from the multi-colored fiber pile fabric comprising a ground structure portion having a knit or weave structure formed from organic fiber yarns and at least one cut pile layer comprising a plurality of cut piles, combined with the ground structure portion by a knitting or weaving procedure of the organic fiber yarns, and extending outward from at least one surface side of the ground structure portion, the cut pile layer comprises (1) non-crimped pile fibers comprising non-crimped organic fibers, (2) crimped pile fibers comprising crimped organic fibers and having a pile height lower than that of the non-crimped pile fibers (1), and (3) crimped or non-crimped pile fibers comprising crimped or non-crimped organic fibers and having a pile height lower than that of the crimped pile fibers (2), and at least one type of pile fibers of the pile fibers (1), (2) and (3) having a color different in lightness or hue or in lightness and hue from the other or others, wherein in at least one partial region of the cut pile layer, top portions of the non-crimped pile fibers (1) are removed by a chemical etching procedure to such an extent that the remaining non-crimped pile fibers (1-*a*) have a pile height controlled within the range of lower than that of the original non-crimped pile fibers (1) but not lower than that of the crimped pile fibers (2), to thereby increase the degree of exposure of the top portions of the crimped pile fibers (2) located in the partial region.

2. The concave and convex-patterned multi-colored pile fabric as claimed in claim 1, wherein the cut pile layer comprises mixed fiber cut piles, in each of which piles, three types of the pile fibers of the non-crimped pile fibers ( ), the crimped pile fibers (2) and crimped or non-crimped pile fibers (3) are mixed altogether.

3. The concave and convex-patterned multi-colored pile fabric as claimed in claim 1, wherein the cut pile layer comprises mixed fiber cut piles, in each of which piles, at least two types of pile fibers of the non-crimped pile fibers (1), the crimped pile fibers (2) and the crimped or non-crimped pile fibers (3) are mixed with each other.

4. The concave and convex-patterned multi-colored pile fabric as claimed in claim 1, wherein the cut pile layer comprises a plurality of non-crimped cut piles consisting of only the non-crimped pile fibers (1), a plurality of crimped cut piles consisting of only the crimped pile fibers (2) and a plurality of crimped or non-crimped cut piles consisting of only the crimped or non-crimped pile fibers (3).

5. The concave and convex-patterned multi-colored pile fabric as claimed in claim 1, wherein the non-crimped pile fibers (1) are selected from the group consisting of non-crimped polyethylene terephthalate fibers, non-crimped polybutylene terephthalate fibers, non-crimped polytetramethylene terephthalate fibers, and non-crimped polytrimethylene terephthalate fibers.

6. The concave and convex-patterned multi-colored pile fabric as claimed in claim 1, wherein the crimped pile fibers (2) are selected front cationic dye-dyeable crimped polyester fibers.

7. The concave and convex-patterned multi-colored pile fabric as claimed in claim 1, wherein the crimped or non-crimped pile fibers (3) comprise a polyester copolymer, the principal monomers or the copolymer are ethylene glycol and terephthalic acid, the comonomer copolymerized with the principal monomers is at least one member selected from isophthalic acid, naphthalene dicarboxylic acid, adipic acid, and sebacic acid, diethyleneglycol, polyethyleneglycols, bis-phenol and bis-phenol sulfon.

8. The concave and convex-patterned multi-colored pile fabric as claimed in claim 1, wherein either one type of pile fibers or the non-crimped pile fibers (1) and the crimped or non-crimped pile fibers (3) are colored with a pigment mixed in to a polymer component from which the pile fibers are formed.

9. The concave and convex patterned multi-colored fiber pile of fabric as claimed in any one of claims 1 and 2 to 8, wherein in at least one partial region of the cut pile layer, top portions of the non-crimped pile fibers (1) and the crimped pile fibers (2) are further removed, together with the top portions of the non-crimped pile fibers (1), by a chemical etching procedure to such an extent that the remaining non-crimped pile fibers (1-*a*) and the remaining crimped pile fibers (2-*a*) have pile heights controlled within the range of lower than that of the original crimped pile fibers (2) but not lower than that of the crimped or non-crimped pile fibers (3), to thereby increase the degree of exposure of the top portions of the remaining crimped pile fibers (2-*a*) and the crimped or non-crimped pile fibers (3) located in the partial region.

* * * * *